US009489906B2

(12) United States Patent
Yao et al.

(10) Patent No.: US 9,489,906 B2
(45) Date of Patent: Nov. 8, 2016

(54) DRIVING STRUCTURE OF LIQUID CRYSTAL DISPLAY PANEL, LIQUID CRYSTAL DISPLAY PANEL, AND DRIVING METHOD THEREOF

(71) Applicant: SHENZHEN CHINA STAR OPTOELECTRONICS TECHNOLOGY CO., LTD., Shenzhen (CN)

(72) Inventors: Xiaohui Yao, Shenzhen (CN); Je Hao Hsu, Shenzhen (CN); Tien Hao Chang, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/416,859

(22) PCT Filed: Dec. 30, 2014

(86) PCT No.: PCT/CN2014/095581

§ 371 (c)(1),
(2) Date: Oct. 27, 2015

(87) PCT Pub. No.: WO2016/090697

PCT Pub. Date: Jun. 16, 2016

(65) Prior Publication Data

US 2016/0171945 A1 Jun. 16, 2016

(30) Foreign Application Priority Data

Dec. 10, 2014 (CN) ..... 2014 1 0759206

(51) Int. Cl.
*G09G 3/36* (2006.01)

(52) U.S. Cl.
CPC ..... *G09G 3/3648* (2013.01); *G09G 3/3674* (2013.01); *G09G 3/3696* (2013.01); *G09G 2300/0426* (2013.01); *G09G 2330/027* (2013.01)

(58) Field of Classification Search
CPC ..... G09G 3/3648; G09G 3/3674; G09G 3/3696; G09G 2330/027; G09G 2300/0426
See application file for complete search history.

(56) References Cited

U.S. PATENT DOCUMENTS

2010/0295837 A1* 11/2010 Yoshinaga ..... G09G 3/003 345/211
2011/0128269 A1* 6/2011 Lee ..... G02B 27/26 345/211
2012/0146994 A1* 6/2012 Jeong ..... H04N 13/0497 345/419

* cited by examiner

*Primary Examiner* — Alexander Eisen
*Assistant Examiner* — Abhishek Sarma
(74) *Attorney, Agent, or Firm* — Buchanan Ingersoll & Rooney PC

(57) ABSTRACT

The present disclosure discloses a driving device for liquid crystal display panel, a liquid crystal display panel, and a driving method thereof, said driving device comprising: a plurality of scanning lines, a first control circuit, a second control circuit, and a third control circuit. According to the present disclosure, three control circuits are added to the driving device of the liquid crystal display panel, whereby normal two dimensional display can be realized without additional cost being added therein. The black frame insertion technology for eliminating the cross-talk phenomena during three dimensional display can be used, i.e., the dual-gates, which are used for reducing the influence of high frame rate on the charging of the liquid crystal panel, can be turned on simultaneously.

11 Claims, 2 Drawing Sheets

DRIVING STRUCTURE OF LIQUID CRYSTAL DISPLAY PANEL, LIQUID CRYSTAL DISPLAY PANEL, AND DRIVING METHOD THEREOF

CROSS REFERENCE TO RELATED APPLICATION

The present application claims benefit of Chinese patent application CN 201410759206.2, entitled "Driving Structure of Liquid Crystal Display Panel, Liquid Crystal Display Panel, and Driving Method Thereof" and filed on Dec. 10, 2014, which is incorporated herein by reference.

FIELD OF THE INVENTION

The present disclosure relates to the technical field of liquid crystal display, and particularly to a driving device for liquid crystal display panel, a liquid crystal display panel, and a driving method thereof.

BACKGROUND OF THE INVENTION

With the rapid development of three dimensional (3D) display technology and the gradual mature of the product lines thereof, the 3D display technology has become one of the most important technologies in the development of flat panel display devices. The mainstream three dimensional (3D) display technologies in the current market comprise anaglyphic 3D display technology, polarization 3D display technology, 3D shutter glass display technology, and naked eye 3D display technology. The 3D shutter glass display technology is widely accepted in the market thanks to its advantages of prominent three dimensional display effects, high resolution of the screen, and relatively low cost of the liquid crystal module.

One frame image can be separated into two frame images corresponding to the left eye and the right eye respectively through the 3D shutter glass display technology. The two frame images are displayed continuously and alternately on the liquid crystal display screen, and the switches of the lenses of the shutter glass are controlled synchronously, so that the left eye and the right eye can see the corresponding image at the right time respectively. At last, the two different images seen by the left eye and the right eye can jointly form the three dimensional effect of the original image in the brain.

However, due to the influence of the response speed of liquid crystal, the cross-talk phenomena would appear. For example, when the left eye is watching the left-eye image, it would watch the residual part of the right-eye image of the last frame, which would lead to the phenomenon of the left-eye image and the right-eye image overlapping with each other. In this case, the ghost image would appear. This kind of phenomenon exists in all shutter 3D televisions based on liquid crystal display technology. In order to reduce the cross-talk phenomena during 3D display, the scanning switching technology or the dynamic local dimming technology are usually used in the back-light unit.

Since the structure of the control circuit needed in the scanning switching technology and the dynamic local dimming technology is complex, and the cost thereof is relatively high, a solution that a black frame is inserted between left-eye signals and right-eye signals whereby the cross-talk phenomena thereof can be reduced is proposed. However, since the left eye and the right eye receive signals alternately in the shutter 3D technology, the requirement on the frame rate thereof is relatively high, which is 120 Hz in general. If the black frame insertion technology is adopted, the frame rate thereof should be doubled, which would have a large effect on the charging of the liquid crystal panel. Therefore, another solution through which the dual-gates are turned on simultaneously during 3D display, so as to reduce the resolution in the scanning direction and raise the charging time is proposed. However, new and complex designs should be added on the Printed Circuit Board (PCB) and the gate IC in order to realize the above functions.

Therefore, how to reduce the cross-talk phenomena in the shutter 3D display technology through black frame insertion technology, as well as reduce the influence of high frame rate on the charging of the liquid crystal panel without new complicated design being added therein has become an effort demanding task in the industry.

SUMMARY OF THE INVENTION

One of the technical problems to be solved by the present disclosure is to provide a driving device for liquid crystal display panel, whereby the cross-talk phenomena in the shutter 3D display technology can be reduced through black frame insertion technology, and the influence of high frame rate on the charging of the liquid crystal panel can be reduced, without new complicated design being added therein. In addition, the present disclosure further provides a liquid crystal display panel comprising said driving device and the driving method thereof.

1. In order to solve the aforesaid technical problem, the present disclosure provides a driving device for liquid crystal display panel, comprising: a plurality of scanning lines; a first control circuit, configured to control the transmission of scanning signals of all odd-numbered scanning lines of said plurality of scanning lines; a second control circuit, configured to control the transmission of scanning signals of all even-numbered scanning lines of said plurality of scanning lines; and a third control circuit, configured to realize different connection states in each pair of scanning lines, which consists of an odd-numbered scanning line and a corresponding even-numbered scanning line, of said plurality of scanning lines under different display modes, said display modes comprising two dimensional display mode and three dimensional display mode.

2. In one preferred embodiment of item 1 of the present disclosure, wherein said first control circuit comprises: a first specified number of switching transistors, each switching transistor being connected to a corresponding odd-numbered scanning line of said plurality of scanning lines respectively; and a first control signal line, configured to control the on/off state of each switching transistor, said first control signal line being connected to the gate of each of said first specified number of switching transistors, wherein said second control circuit comprises: a second specified number of switching transistors, each switching transistor being connected to a corresponding even-numbered scanning line of said plurality of scanning lines respectively; and a second control signal line, configured to control the on/off state of each switching transistor, said second control signal line being connected to the gate of each of said second specified number of switching transistors, and wherein said third control circuit comprises: a third specified number of switching transistors, each switching transistor being connected between the odd-numbered scanning line and the even-numbered scanning line of a corresponding pair of scanning lines respectively; and a third control signal line, configured to control the on/off state of each switching transistor, said third control signal line being connected to the gate of each of said third specified number of switching transistors.

3. In one preferred embodiment of item 1 or item 2 of the present disclosure, said first control circuit, said second control circuit, and said third control circuit are all arranged between a fanout area and an active area of the liquid crystal display panel.

4. According to another aspect of the present disclosure, the present disclosure further provides a liquid crystal display panel, said liquid crystal display panel comprising the driving device according to any one of items 1 to 3.

5. According to another aspect of the present disclosure, the present disclosure further provides a method for driving liquid crystal display panel, said liquid crystal display panel comprising a plurality of scanning lines, a first control circuit, a second control circuit, and a third control circuit, said method comprising: during a display stage under different display modes, controlling, by said first control circuit, the transmission of scanning signals of all odd-numbered scanning lines of said plurality of scanning lines; controlling, by said second control circuit, the transmission of scanning signals of all even-numbered scanning lines of said plurality of scanning lines; and realizing, by said third control circuit, different connection states in each pair of scanning lines, which consists of an odd-numbered scanning line and a corresponding even-numbered scanning line, of said plurality of scanning lines.

6. In one preferred embodiment of item 5 of the present disclosure, the method further comprises: during a display stage under two dimensional display mode, realizing, by said third control circuit, a disconnected state between the odd-numbered scanning line and the even-numbered scanning line in each pair of scanning lines of said plurality of scanning lines.

7. In one preferred embodiment of item 5 or item 6 of the present disclosure, the method further comprises: during a display stage under three dimensional display mode, realizing, by said third control circuit, a short-circuit state between the odd-numbered scanning line and the even-numbered scanning line in each pair of scanning lines of said plurality of scanning lines.

8. In one preferred embodiment of any one of items 5 to 7 of the present disclosure, the method further comprises: during a display stage under two dimensional display mode, providing, by the first control signal line of said first control circuit, a turn-on voltage to each of the first specified number of switching transistors, so as to control the transmission of scanning signals of all odd-numbered scanning lines of said plurality of scanning lines, wherein the gate of each of said first specified number of switching transistors is connected to said first control signal line; providing, by the second control signal line of said second control circuit, a turn-on voltage to each of the second specified number of switching transistors, so as to control the transmission of scanning signals of all even-numbered scanning lines of said plurality of scanning lines, wherein the gate of each of said second specified number of switching transistors is connected to said second control signal line; and providing, by the third control signal line of said third control circuit, a turn-off voltage to each of the third specified number of switching transistors, so as to turn off the connection between the odd-numbered scanning line and the even-numbered scanning line in each pair of scanning lines, wherein the gate of each of said third specified number of switching transistors is connected to said third control signal line.

9. In one preferred embodiment of any one of items 5 to 8 of the present disclosure, the method further comprises: during a display stage under three dimensional display mode, providing, by said first control signal line, when all odd-numbered scanning lines of said plurality of scanning lines are turned on, a turn-on voltage to each of the first specified number of switching transistors, so as to control the transmission of scanning signals of all odd-numbered scanning lines; providing, by said second control signal line, when all even-numbered scanning lines of said plurality of scanning lines are turned on, a turn-on voltage to each of the second specified number of switching transistors, so as to control the transmission of scanning signals of all even-numbered scanning lines; and providing, by said third control signal line, during the whole scanning cycle, a turn-on voltage to each of the third specified number of switching transistors, so as to realize short-circuit state between the odd-numbered scanning line and the even-numbered scanning line in each pair of scanning lines.

Compared with the prior art, one embodiment or a plurality of embodiments of the present disclosure may have the following advantages.

According to the present disclosure, three control circuits are added to the driving circuit of the liquid crystal display panel, whereby normal two dimensional display can be realized. Moreover, the black frame insertion technology for eliminating the cross-talk phenomena during three dimensional display can be also used, i.e., the dual-gates, which are used for reducing the influence of high frame rate on the charging of the liquid crystal panel, can be turned on simultaneously. In addition, the three added control circuits can be realized only with several empty pins of the driving Integrated Circuit (IC), which means no new additional design is necessary.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings are used to provide further understandings of the present disclosure and constitute one part of the description. The drawings are used for interpreting the present disclosure together with the embodiments, not for limiting the present disclosure. In the drawings.

DETAILED DESCRIPTION OF THE EMBODIMENTS

The present disclosure will be illustrated in detail hereinafter in combination with the accompanying drawings to make the purpose, technical solutions, and advantages of the present disclosure more clear.

Figure 1:
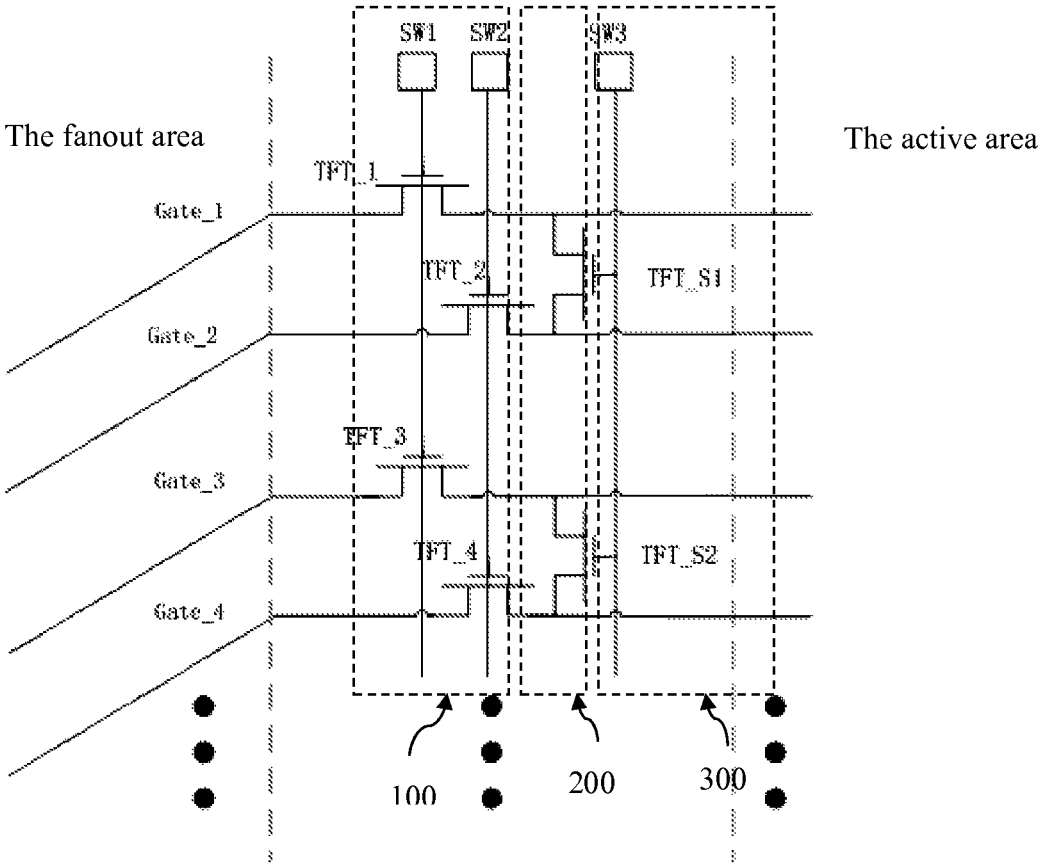
FIG. 1 schematically shows an equivalent circuit of a driving device of a liquid crystal display panel according to one embodiment of the present disclosure.

FIG. 1 schematically shows an equivalent circuit of a driving device of a liquid crystal display panel according to one embodiment of the present disclosure. The driving circuit comprises a plurality of scanning lines, such as Gate_1, Gate_2, Gate_3, and Gate_4 as shown in FIG. 1. The driving circuit further comprises a first control circuit 100, a second control circuit 200, and a third control circuit 300 that are all arranged between a fanout area and an active area (AA area). The first control circuit 100 is configured to control the transmission of scanning signals of all odd-numbered scanning lines (such as Gate_1 and Gate_3 as shown in FIG. 1) of said plurality of scanning lines. The second control circuit 200 is configured to control the transmission of scanning signals of all even-numbered scanning lines (such as Gate_2 and Gate_4 as shown in FIG. 1) of said plurality of scanning lines. The third control circuit 300 is configured to realize different connection states between the odd-numbered scanning line and the even-numbered scanning line in each pair of scanning lines (such as Gate_1 and Gate_2, as well as Gate_3 and Gate_4 as shown in FIG. 1) of said plurality of scanning lines under different display modes, said display modes comprising two dimensional display mode and three dimensional display mode.

As shown in FIG. 1, the first control circuit 100 comprises a plurality of (a first specified number of) switching transistors (such as TFT_1 and TFT_3 as shown in FIG. 1) and a first control signal line SW1. Each switching transistor is connected to a corresponding odd-numbered scanning line of the plurality of scanning lines, and the number of the switching transistors is the same as the number of the odd-numbered scanning lines. The first control signal line SW1 is configured to control the on/off state of each switching transistor, and is connected to the gate of each of the switching transistors of the first control circuit 100.

The second control circuit 200 comprises a plurality of (a second specified number of) switching transistors (such as TFT_2 and TFT_4 as shown in FIG. 1) and a second control signal line SW2. Each switching transistor is connected to a corresponding even-numbered scanning line of the plurality of scanning lines, and the number of the switching transistors is the same as the number of the even-numbered scanning lines. The second control signal line SW2 is configured to control the on/off state of each switching transistor, and is connected to the gate of each of the switching transistors of the second control circuit.

The third control circuit 300 comprises a plurality of (a third specified number of) switching transistors (such as TFT_S1 and TFT_S2 as shown in FIG. 1) and a third control signal line SW3. Each switching transistor is connected between the odd-numbered scanning line and the even-numbered scanning line of a corresponding pair of scanning lines. For example, the switching transistor TFT_S1 is bridged between the odd-numbered scanning line Gate_1 and the even-numbered scanning line Gate_2 of the first pair of scanning lines, and the switching transistor TFT_S2 is bridged between the odd-numbered scanning line Gate_3 and the even-numbered scanning line Gate_4 of the second pair of scanning lines. The third control signal line SW3 is configured to control the on/off state of each switching transistor, and is connected to the gate of each of the switching transistors of the third control circuit.

The driving procedure when the display panel comprising the above driving device is performing 2D display and 3D display is interpreted in detail hereinafter.

Figure 2:
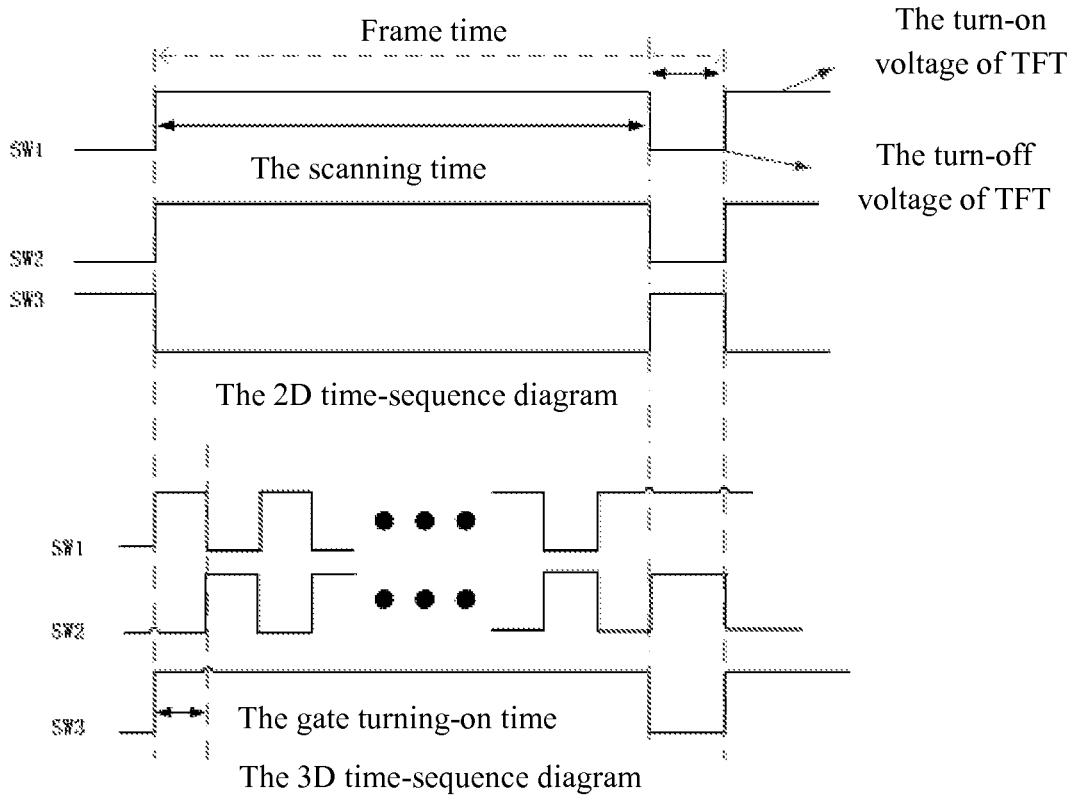
FIG. 2 is a time-sequence diagram when a display panel comprising the driving circuit as shown in FIG. 1 is performing 2D display and 3D display.

Reference can be made to FIG. 2, which is a time-sequence diagram when a display panel comprising the driving circuit as shown in FIG. 1 is performing 2D display and 3D display.

During a display stage under two dimensional display mode, the transmission of scanning signals of all odd-numbered scanning lines of the plurality of scanning lines are controlled by the first control circuit 100; the transmission of scanning signals of all even-numbered scanning lines of the plurality of scanning lines are controlled by the second control circuit 200; and the connection between the odd-numbered scanning line and the even-numbered scanning line in each pair of scanning lines is turned off by the third control circuit 300.

Specifically, as shown in the upper view (2D time-sequence diagram) of FIG. 2, in a scanning cycle, the first control signal line SW1 provides a turn-on voltage (the high-level voltage as shown in FIG. 2) to each switching transistor connected thereto, so as to control the transmission of scanning signals of each odd-numbered scanning line. At the same time, the second control signal line SW2 provides a turn-on voltage (the high-level voltage as shown in FIG. 2) to each switching transistor connected thereto, so as to control the transmission of scanning signals of each even-numbered scanning line. During the same time period, the third control signal line SW3 provides a turn-off voltage (the low-level voltage as shown in FIG. 2) to each switching transistor connected thereto, so as to turn off the connection between the odd-numbered scanning line and the even-numbered scanning line in each pair of scanning lines of the plurality of scanning lines.

Through the above driving procedures, a progressive scanning of the plurality of scanning lines can be achieved, and thus a normal two dimensional display can be realized.

During a display stage under three dimensional display mode, the transmission of the scanning signals of all odd-numbered scanning lines of the plurality of scanning lines is controlled by the first control circuit 100; the transmission of the scanning signals of all even-numbered scanning lines of the plurality of scanning lines is controlled by the second control circuit 200; and the odd-numbered scanning line and the even-numbered scanning line in each pair of scanning lines of the plurality of scanning lines are connected with each other through short-circuit by the control of the third control circuit 300.

Specifically, as shown in the lower view (3D time-sequence diagram) of FIG. 2, during a scanning cycle, when all odd-numbered scanning lines are turned on, the first control signal line SW1 provides a turn-on voltage to each switching transistor connected thereto, so as to control the transmission of the scanning signals of all odd-numbered scanning lines. When all even-numbered scanning lines are turned on, the second control signal line SW2 provides a turn-on voltage to each switching transistor connected thereto, so as to control the transmission of the scanning signals of all even-numbered scanning lines. The signal of the first control signal line SW1 is opposite to the signal of the second control signal line SW2, i.e., when the signal of the first control signal line SW1 is a turn-on voltage, the signal of the second control signal line SW2 is a turn-off voltage. When the third control signal line SW3 provides a turn-on voltage to each switching transistor connected thereto, a short-circuit state between the odd-numbered scanning line and the even-numbered scanning line in each pair of scanning lines of the plurality of scanning lines can be realized.

Through the above driving procedures, during the black frame inserting process in the three dimensional display stage, the dual-gates, which are provided to reduce the influence of high frame rate on the charging of the liquid crystal panel, can be turned on simultaneously. That is to say, all odd-numbered scanning lines or all even-numbered scanning lines can be turned on simultaneously. In this manner, the resolution in the scanning direction can be reduced, the charging time can be improved, and a better 3D display effect can be realized.

In summary, three control circuits are added between a fanout area and an active area of a liquid crystal display panel, wherein two control circuits mean adding a TFT control switch to each of all odd-numbered scanning lines and all even-numbered scanning lines respectively, and the third control circuit means adding a TFT control switch between an odd-numbered scanning line and a corresponding even-numbered scanning line which together form a pair of scanning lines. By means of the three control circuits, a normal two dimensional display can be realized, and the dual-gates can be turned on simultaneously through SG black frame insertion technology during 3D display. In addition, the three control circuits can be realized only with several empty pins of the driving IC, which means no new additional design is necessary. The display effect thereof can be improved, and at the same time, the cost thereof can be reduced.

The preferred embodiments of the present disclosure are stated hereinabove, but the protection scope of the present disclosure is not limited by this. Any changes or substitutes readily conceivable for any one skilled in the art within the technical scope disclosed by the present disclosure shall be covered by the protection scope of the present disclosure. Therefore, the protection scope of the present disclosure shall be determined by the scope as defined in the claims.

The invention claimed is:

1. A driving device for liquid crystal display panel, comprising:

a plurality of scanning lines;

a first control circuit, configured to control the transmission of scanning signals of all odd-numbered scanning lines of said plurality of scanning lines;

a second control circuit, configured to control the transmission of scanning signals of all even-numbered scanning lines of said plurality of scanning lines; and a third control circuit, configured to realize different connection states in each pair of scanning lines, which consists of an odd-numbered scanning line and a corresponding even-numbered scanning line, of said plurality of scanning lines under different display modes, said display modes comprising two dimensional display mode and three dimensional display mode, wherein said third control circuit comprises:

a third specified number of switching transistors, each switching transistor being connected between the odd-numbered scanning line and the even-numbered scanning line of a corresponding pair of scanning lines respectively; and a third control signal line, configured to control the on/off state of each switching transistor, said third control signal line being connected to the gate of each of said third specified number of switching transistors.

2. The driving device according to claim 1, wherein said first control circuit comprises:

a first specified number of switching transistors, each switching transistor being connected to a corresponding odd-numbered scanning line of said plurality of scanning lines respectively; and a first control signal line, configured to control the on/off state of each switching transistor, said first control signal line being connected to the gate of each of said first specified number of switching transistors, wherein said second control circuit comprises:

a second specified number of switching transistors, each switching transistor being connected to a corresponding even-numbered scanning line of said plurality of scanning lines respectively; and a second control signal line, configured to control the on/off state of each switching transistor, said second control signal line being connected to the gate of each of said second specified number of switching transistors.

3. The driving device according to claim 2, wherein said first control circuit, said second control circuit, and said third control circuit are all arranged between a fanout area and an active area of the liquid crystal display panel.

4. A liquid crystal display panel, comprising a driving device, said driving device comprises:

a plurality of scanning lines;

a first control circuit, configured to control the transmission of scanning signals of all odd-numbered scanning lines of said plurality of scanning lines;

a second control circuit, configured to control the transmission of scanning signals of all even-numbered scanning lines of said plurality of scanning lines; and a third control circuit, configured to realize different connection states in each pair of scanning lines, which consists of an odd-numbered scanning line and a corresponding even-numbered scanning line, of said plurality of scanning lines under different display modes, said display modes comprising two dimensional display mode and three dimensional display mode, wherein said third control circuit comprises:

a third specified number of switching transistors, each switching transistor being connected between the odd-numbered scanning line and the even-numbered scanning line of a corresponding pair of scanning lines respectively; and a third control signal line, configured to control the on/off state of each switching transistor, said third control signal line being connected to the gate of each of said third specified number of switching transistors.

5. The liquid crystal display panel according to claim 4, wherein said first control circuit comprises:

a first specified number of switching transistors, each switching transistor being connected to a corresponding odd-numbered scanning line of said plurality of scanning lines respectively; and a first control signal line, configured to control the on/off state of each switching transistor, said first control signal line being connected to the gate of each of said first specified number of switching transistors, wherein said second control circuit comprises:

a second specified number of switching transistors, each switching transistor being connected to a corresponding even-numbered scanning line of said plurality of scanning lines respectively; and a second control signal line, configured to control the on/off state of each switching transistor, said second control signal line being connected to the gate of each of said second specified number of switching transistors.

6. The liquid crystal display panel according to claim 5, wherein said first control circuit, said second control circuit, and said third control circuit are all arranged between a fanout area and an active area of the liquid crystal display panel.

7. A method for driving liquid crystal display panel, said liquid crystal display panel comprising a plurality of scanning lines, a first control circuit, a second control circuit, and a third control circuit, said method comprising:

during a display stage under different display modes, controlling, by said first control circuit, the transmission of scanning signals of all odd-numbered scanning lines of said plurality of scanning lines;

controlling, by said second control circuit, the transmission of scanning signals of all even-numbered scanning lines of said plurality of scanning lines; and realizing, by said third control circuit, different connection states in each pair of scanning lines, which consists of an odd-numbered scanning line and a corresponding even-numbered scanning line, of said plurality of scanning lines, wherein during a display stage under two dimensional display mode, the third control signal line of said third control circuit provides a turn-off voltage to each of the third specified number of switching transistors, so as to turn off the connection between the odd-numbered scanning line and the even-numbered scanning line in each pair of scanning lines, wherein the gate of each of said third specified number of switching transistors is connected to said third control signal line; and wherein during a display stage under three dimensional display mode, the third control signal line provides, during the whole scanning cycle, a turn-on voltage to each of the third specified number of switching transistors, so as to realize a short-circuit state between the odd-numbered scanning line and the even-numbered scanning line in each pair of scanning lines.

8. The method according to claim 7, further comprising:

during a display stage under two dimensional display mode, realizing, by said third control circuit, a disconnected state between the odd-numbered scanning line and the even-numbered scanning line in each pair of scanning lines of said plurality of scanning lines.

9. The method according to claim 7, further comprising:

during a display stage under three dimensional display mode, realizing, by said third control circuit, a short-circuit state between the odd-numbered scanning line and the even-numbered scanning line in each pair of scanning lines of said plurality of scanning lines.

10. The method according to claim 7, further comprising:

during a display stage under two dimensional display mode, providing, by the first control signal line of said first control circuit, a turn-on voltage to each of the first specified number of switching transistors, so as to control the transmission of scanning signals of all odd-numbered scanning lines of said plurality of scanning lines, wherein the gate of each of said first specified number of switching transistors is connected to said first control signal line; and providing, by the second control signal line of said second control circuit, a turn-on voltage to each of the second specified number of switching transistors, so as to control the transmission of scanning signals of all even-numbered scanning lines of said plurality of scanning lines, wherein the gate of each of said second specified number of switching transistors is connected to said second control signal line.

11. The method according to claim 10, further comprising:

during a display stage under three dimensional display mode, providing, by said first control signal line, when all odd-numbered scanning lines of said plurality of scanning lines are turned on, a turn-on voltage to each of the first specified number of switching transistors, so as to control the transmission of scanning signals of all odd-numbered scanning lines; and providing, by said second control signal line, when all even-numbered scanning lines of said plurality of scanning lines are turned on, a turn-on voltage to each of the second specified number of switching transistors, so as to control the transmission of scanning signals of all even-numbered scanning lines.

* * * * *